US011583077B2

(12) United States Patent
Salice

(10) Patent No.: US 11,583,077 B2
(45) Date of Patent: Feb. 21, 2023

(54) PULL-OUT GUIDE FOR DRAWERS PROVIDED WITH A DEVICE FOR THE HEIGHT ADJUSTMENT OF THE DRAWER

(71) Applicant: ARTURO SALICE S.P.A., Novedrate (IT)

(72) Inventor: Sergio Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 70 days.

(21) Appl. No.: 17/264,578

(22) PCT Filed: Jun. 13, 2019

(86) PCT No.: PCT/EP2019/065505
§ 371 (c)(1),
(2) Date: Jan. 29, 2021

(87) PCT Pub. No.: WO2020/025213
PCT Pub. Date: Feb. 6, 2020

(65) Prior Publication Data

US 2021/0330079 A1 Oct. 28, 2021

(30) Foreign Application Priority Data

Jul. 30, 2018 (IT) ..... 102018000007604

(51) Int. Cl.
*A47B 88/43* (2017.01)
*A47B 88/477* (2017.01)

(52) U.S. Cl.
CPC ..... *A47B 88/43* (2017.01); *A47B 88/477* (2017.01); *A47B 2210/0018* (2013.01); *A47B 2210/0054* (2013.01)

(58) Field of Classification Search
CPC ..... A47B 88/43; A47B 88/477; A47B 2210/0018; A47B 2210/0054; A47B 88/427; A47B 88/407
See application file for complete search history.

(56) References Cited

U.S. PATENT DOCUMENTS 5,375,922 A * 12/1994 Brustle ..... A47B 88/427 312/334.4
5,664,855 A * 9/1997 Lautenschlager .... A47B 88/427 312/334.4

(Continued)

FOREIGN PATENT DOCUMENTS

CN 103167814 A 6/2013
CN 104780809 A 7/2015

(Continued)

OTHER PUBLICATIONS

International Search Report and Written Opinion dated Jul. 8, 2019 issued in PCT/EP2019/065505.

(Continued)

*Primary Examiner* — Hanh V Tran
(74) *Attorney, Agent, or Firm* — Scully, Scott, Murphy & Presser, P.C.

(57) ABSTRACT

A pull-out guide for drawers, comprising a fixed guide part which can be anchored to the body of an item of furniture and a movable guide part on which a drawer or the like can be fastened, an adjustment device being provided comprising a guide element for a movable support member, the guide element of the adjustment device being separated from the movable guide part and provided in a single piece with the front stop element and/or the front centering element, the guide element extending inclined with respect to the longitudinal axis of the movable guide part.

14 Claims, 5 Drawing Sheets

(56) References Cited

U.S. PATENT DOCUMENTS

| | | | | |
|---|---|---|---|---|
| 8,052,234 | B2 * | 11/2011 | Liang | A47B 88/427 312/334.4 |
| 9,788,654 | B1 * | 10/2017 | Chen | A47B 88/407 |
| 10,149,539 | B2 * | 12/2018 | McGregor | A47B 88/427 |
| 10,362,871 | B2 * | 7/2019 | Boekhoff | A47B 88/407 |
| 10,470,569 | B2 * | 11/2019 | Chen | A47B 88/407 |
| 10,779,648 | B2 * | 9/2020 | Lucas | A47B 88/407 |
| 10,945,523 | B2 * | 3/2021 | Albrecht | A47B 88/427 |
| 2003/0234603 | A1 * | 12/2003 | Salice | A47B 88/407 312/334.5 |
| 2011/0129172 | A1 * | 6/2011 | Liang | A47B 88/463 384/22 |
| 2014/0015390 | A1 * | 1/2014 | Grabherr | A47B 88/43 312/334.4 |
| 2014/0015392 | A1 * | 1/2014 | Salice | A47B 88/423 312/334.44 |
| 2015/0147008 | A1 * | 5/2015 | McGregor | A47B 88/49 384/22 |
| 2016/0198855 | A1 * | 7/2016 | Liang | A47B 88/427 248/241 |
| 2017/0181544 | A1 * | 6/2017 | McGregor | A47B 88/427 |
| 2018/0255925 | A1 * | 9/2018 | Chen | F16C 29/005 |

FOREIGN PATENT DOCUMENTS

| | | | | |
|---|---|---|---|---|
| CN | 105124953 | A | 12/2015 | |
| CN | 105747614 | B | 11/2017 | |
| CN | 107529885 | A | 1/2018 | |
| DE | 20321444 | U1 | 6/2007 | |
| EP | 2514339 | A1 * | 10/2012 | A47B 88/427 |
| EP | 2613666 | B1 | 11/2016 | |

OTHER PUBLICATIONS

Italian Search Report and Written Opinion dated Jan. 30, 2019 issued in IT 201800007604, with partial translation.

Chinese Office Action dated Mar. 3, 2022 received in Chinese 201980050826.X, together with an English-language translation.

* cited by examiner

PULL-OUT GUIDE FOR DRAWERS PROVIDED WITH A DEVICE FOR THE HEIGHT ADJUSTMENT OF THE DRAWER

The present invention relates to a pull-out guide for drawers which is provided with a device for the height adjustment of the drawer mounted thereupon.

In the furniture sector, it is known to make furniture provided with drawers, which in general are slideably supported by pull-out guides, each guide comprising a fixed guide part which can be connected to a respective side wall of the body of the item of furniture and a movable guide part which can be fastened to a corresponding side of the drawer.

For the purposes of anchoring each side of the drawer to a respective pull-out guide, suitable fastening means are provided which are arranged both at the front and at the rear of the drawer.

Conventionally, the fastening means arranged at the front of the drawer are constituted by a clip hooking device that connects a front end of the drawer to a respective front end of the movable part of the guide, while the fastening means arranged at the rear are constituted by a hook that protrudes longitudinally starting from a rear end of the movable part of the guide so as to be insertable into a respective engagement hole provided on a rear wall of the drawer.

For a correct mutual lateral positioning between the hooking device and the pull-out guide, the movable part of the pull-out guide can likewise have a centering element which can engage a corresponding element which is integral with the clip hooking device, such as for example illustrated in EP 2 613 666.

Then, to define the position of the front panel of the drawer with respect to the body of the item of furniture in the longitudinal direction of extraction of the guides, in general there is a stop element at a front end of the movable part of the guide, which is shaped and arranged to come into contact with the fixed part of the guide when that guide is in the closed position.

Furthermore, in order to adjust the vertical position and/or the inclination of the front of the drawer, in general there can be suitable means for vertical or height adjustment of the position of the drawer with respect to the movable guide part, and such means can be associated with the clip hooking device or with the movable part of the guide.

In particular, if they are associated with the hooking device, the vertical adjustment means usually comprise a wedge element which can be inserted transversely on one side of the pull-out guide so as to be interposed between the movable part of the guide and the lower part of the drawer, such as for example in EP 2 613 666; however, such solution can generate rotations or unwanted torsions of the pull-out guide about its own longitudinal axis.

But if they are associated with the movable guide part, the adjustment means can be constituted by an adjustment element which is supported by that guide so that it can move, for example rotatably as in U.S. Pat. No. 5,375,922 or in an oscillating manner as in U.S. Pat. No. 8,052,234, in order to raise or lower the drawer with respect to the movable guide part.

Such a solution however entails a higher complexity of construction and assembly of the pull-out guide, and can entail a structural weakening thereof if various cuts and openings are provided in the profiled element of the guide, which are necessary for mounting the adjustment element.

Therefore the need exists to have a pull-out guide for drawers which is provided with a device for the height adjustment of those drawers, which is capable of overcoming the above mentioned problems.

The aim of the present invention is therefore to provide a pull-out guide for drawers which is provided with a device for the height adjustment of the drawers, which is simple in construction and which enables a rapid and easy assembly of the various components of the guide.

Within this aim, an object of the present invention is to provide a pull-out guide of the type mentioned above, which has excellent structural characteristics and strength which enable a correct operation of the pull-out guide.

This aim and this and other objects which will become better apparent hereinafter are all achieved by a pull-out guide for drawers and the like, which comprises a fixed guide part which can be anchored to the body of an item of furniture and a movable guide part on which a drawer or the like can be fastened, said movable guide part extending along a longitudinal axis and being provided with a front stop element and/or with a front centering element which are conformed and arranged respectively for coming into contact with the fixed guide part at the closed position of the guide and/or for engaging with an element that is integral with the front part of the said drawer, the pull-out guide being further provided with a height adjustment device of the drawer with respect to the movable guide part, the adjustment device comprising a movable support member for the drawer, characterized in that the adjustment device comprises a guide element for the movable support member, said guide element of the adjustment device being separated from the movable guide part and provided in a single piece with said front stop element and/or said front centering element and in that the guide element extends inclined with respect to the longitudinal axis of the movable guide part.

Further characteristics and advantages of the present invention are further defined in the dependent claims.

The characteristics and the advantages of the present invention will become better apparent from the following description of a preferred but not exclusive embodiment of the pull-out guide, which is illustrated for the purposes of non-limiting example in the accompanying drawings, wherein.

Figure 1:
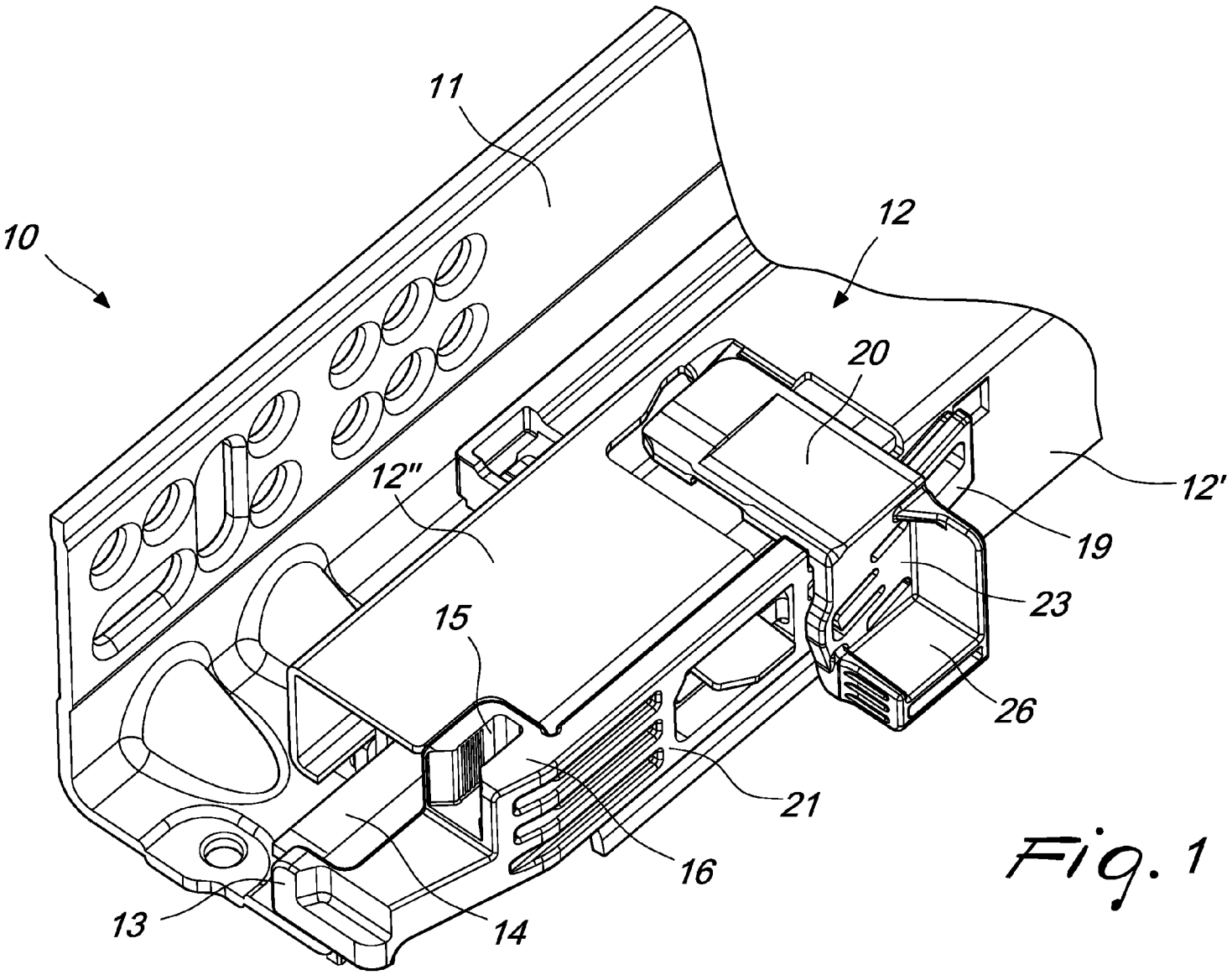
FIG. 1 is a perspective view of the front part of the pull-out guide according to the present invention.
Figure 2:
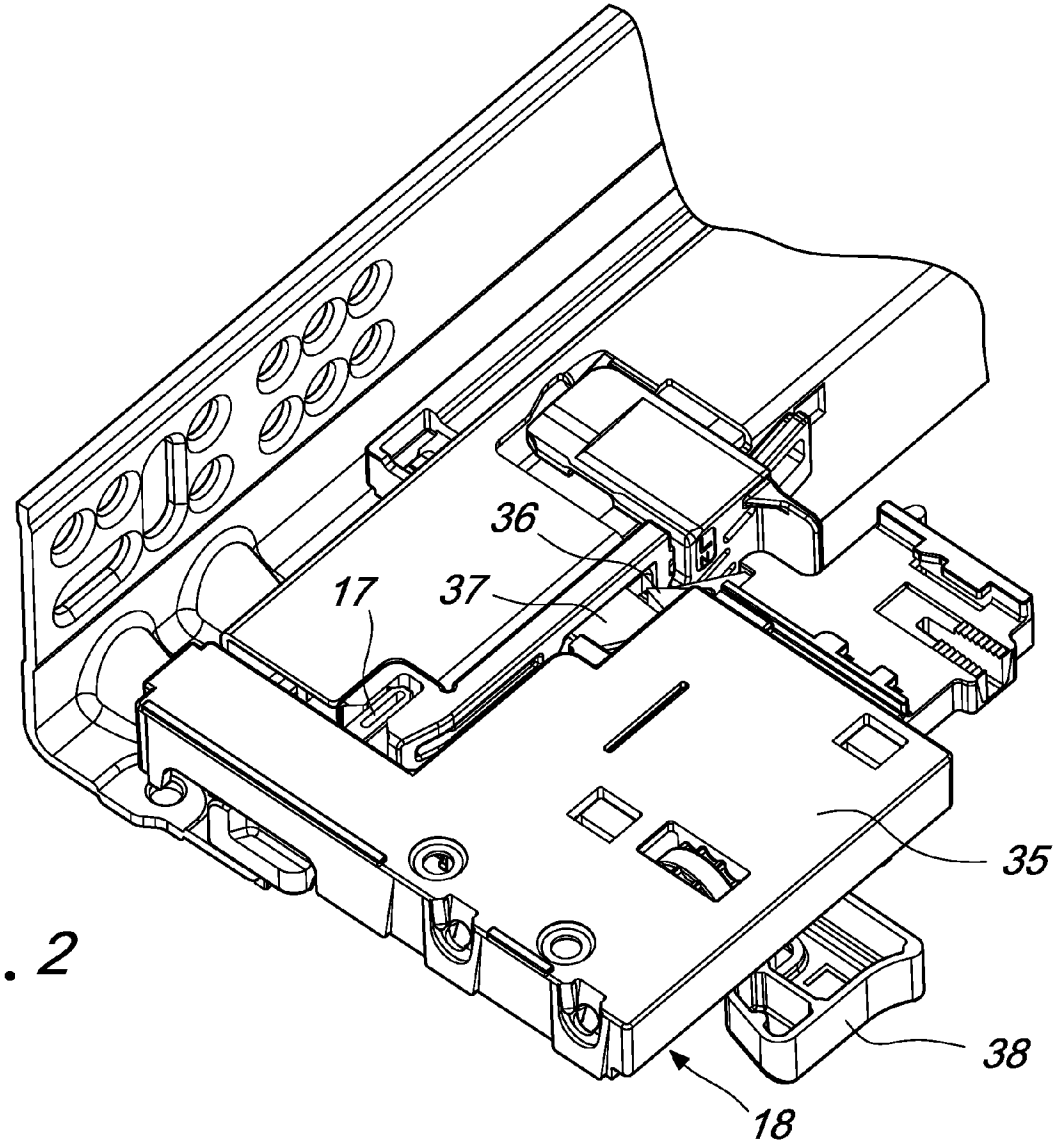
FIG. 2 is a view of the front part of the pull-out guide in FIG. 1, and also shows the clip hooking device which can be fastened underneath the drawer.

With reference to the figures, a pull-out guide for drawers and the like according to a preferred embodiment of the present invention is illustrated, generally designated with the reference numeral 10, and comprises a fixed guide part 11 which can be anchored to the body of an item of furniture and a movable guide part 12 on which a drawer or the like can be fixed, and optionally an intermediate guide part between the fixed guide part 11 and the movable guide part 12.

The fixed guide parts 11 and the movable guide parts 12 also extend along a longitudinal axis, with the movable guide part 12 moving with respect to the fixed guide part 11 along that axis.

To support each individual drawer, a pair of pull-out guides 10 are mounted fastened on respective opposite sides or opposite side walls of the body of the item of furniture.

The movable guide part 12 can be provided with a front stop element 13 which is shaped and arranged to come into contact with the fixed guide part 11 when the guide is in the closed position; in particular, the stop element 13 can be constituted by an element fastened to a front end of the movable guide part 12 and shaped to come into contact for example with a bent, upward-protruding front portion 14 of the fixed guide part 11, when the guide is in the closed position.

The movable guide part 12 can likewise be provided with a front centering element which is shaped and arranged for engaging with a corresponding centering element which is integral with the front part of the drawer.

The front centering element of the guide can be constituted by an engagement seat 15 which is provided in a component 16 which is fastened frontally to the movable guide part 12. The engagement seat 15 can be engaged with the aforementioned element which is integral with the front part of the drawer, for example configured as a wedge element 17 which extends from a clip hooking device 18 which can be fastened to the front end of the drawer in order to connect the drawer to a respective front end of the movable guide part 12.

The possibility is not ruled out of an inverted arrangement of the centering elements, for example providing the engagement seat on the clip hooking device and the wedge element at the front end of the movable guide part.

The pull-out guide is further provided with a device for adjusting the height of the drawer with respect to the movable guide part 12, which comprises a guide element 19 and a support element 20 for the drawer which is connected and supported movably by the guide element 19, the bottom or the side walls of the drawer resting on such element 20.

According to the present invention, the guide element 19 is separated from the movable guide part 12 and is provided in a single piece with the front stop element 13 and/or with the front centering element 15; furthermore, again according to the present invention, the guide element 19 extends inclined with respect to the longitudinal axis of the movable guide part 12.

Preferably, the guide element 19 protrudes inclined at a rear end of a fastening body 21 which is fastened on a side wall 12' of the movable guide part 12 which is directed toward the side of the body of the item of furniture opposite to the fastening side of said guide; at the front end however the fastening body 21 has the front stop element 13 and/or the component 16 which has the front centering element 15.

The inclination of the guide element 19 can be upward or downward, depending if it is desired to obtain the greater adjustment by moving the support member 20 to the rear or to the front of the pull-out guide 10; in the preferred embodiment shown, the guide element 19 protrudes toward the rear end of the guide with upward inclination.

Preferably the guide element 19 and the fastening body 21 are flat and extend along a plane parallel to the side wall 12' of the movable guide part 12 so as to present a limited space occupation perpendicular to the side wall 12'.

Figure 4:
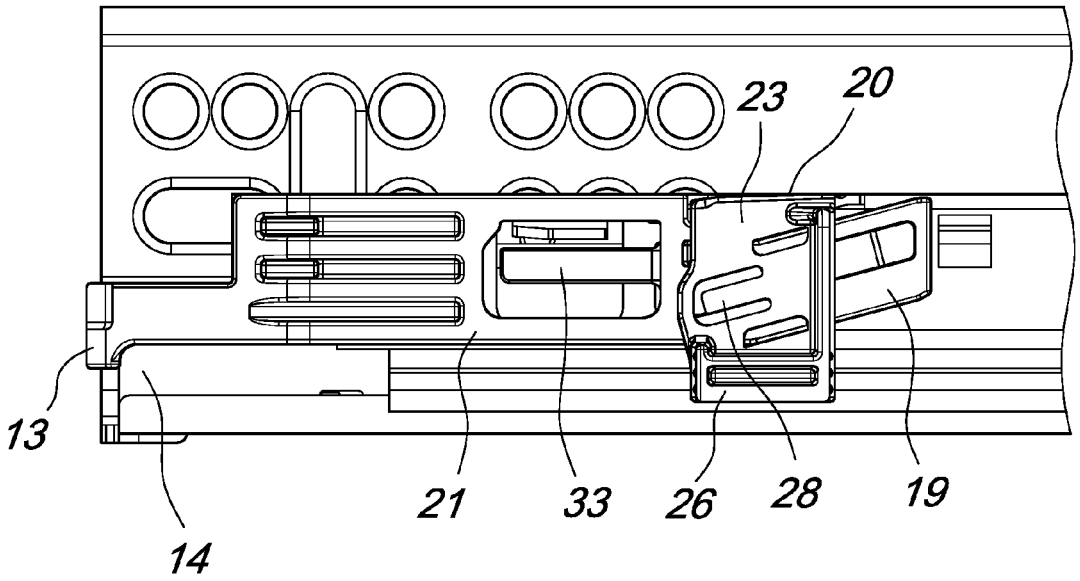
FIG. 4 is a side view of the front part of the pull-out guide according to the present invention, with the height adjustment device for the drawer in a lowered position of minimum adjustment.
Figure 5:
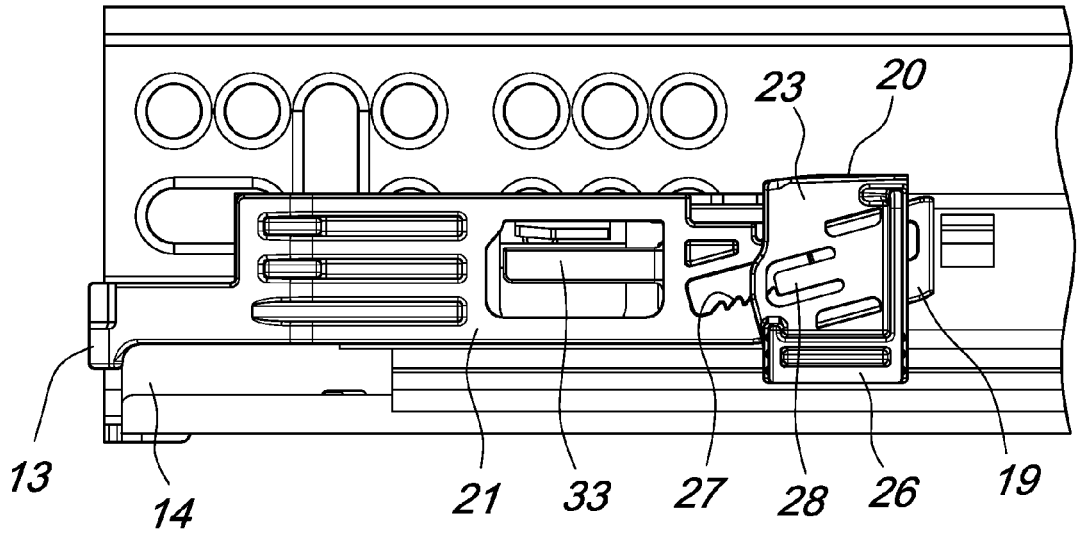
FIG. 5 is the view in FIG. 4, with the height adjustment device of the drawer in a raised position to adjust the drawer.

The movable support member 20 of the drawer is preferably configured as a slider which is connected slideably to the guide element 19 so that it can be moved between an advanced position, shown in FIG. 4, in which the support member 20 is lowered in a position of minimum adjustment such as to lie for example in the same plane as the upper wall 12" of the pull-out guide 12, and a retracted position, shown in FIG. 5, in which the support member 20 is in a raised position for moving the drawer upward and adjusting its height with respect to the upper wall 12" of the pull-out guide 12.

Preferably the support member 20 has a flat shape and extends at an opening 22 in the upper wall 12" of the guide along a plane that is substantially parallel to the upper wall 12"; the support member 20 protrudes from a lateral part 23 for connection to the guide element 19, in which the connection part 23 extends parallel to and side-by-side with the guide element 19 on an opposite side of the element 19 from the side wall 12' of the guide 12.

Since the support member 20 extends at the upper wall 12" of the movable guide part 12, there are no unwanted torsions or stresses of the movable guide part 12 with respect to the fixed guide part 11 when the drawer is height-adjusted and during the operation of the guide.

Figure 6:
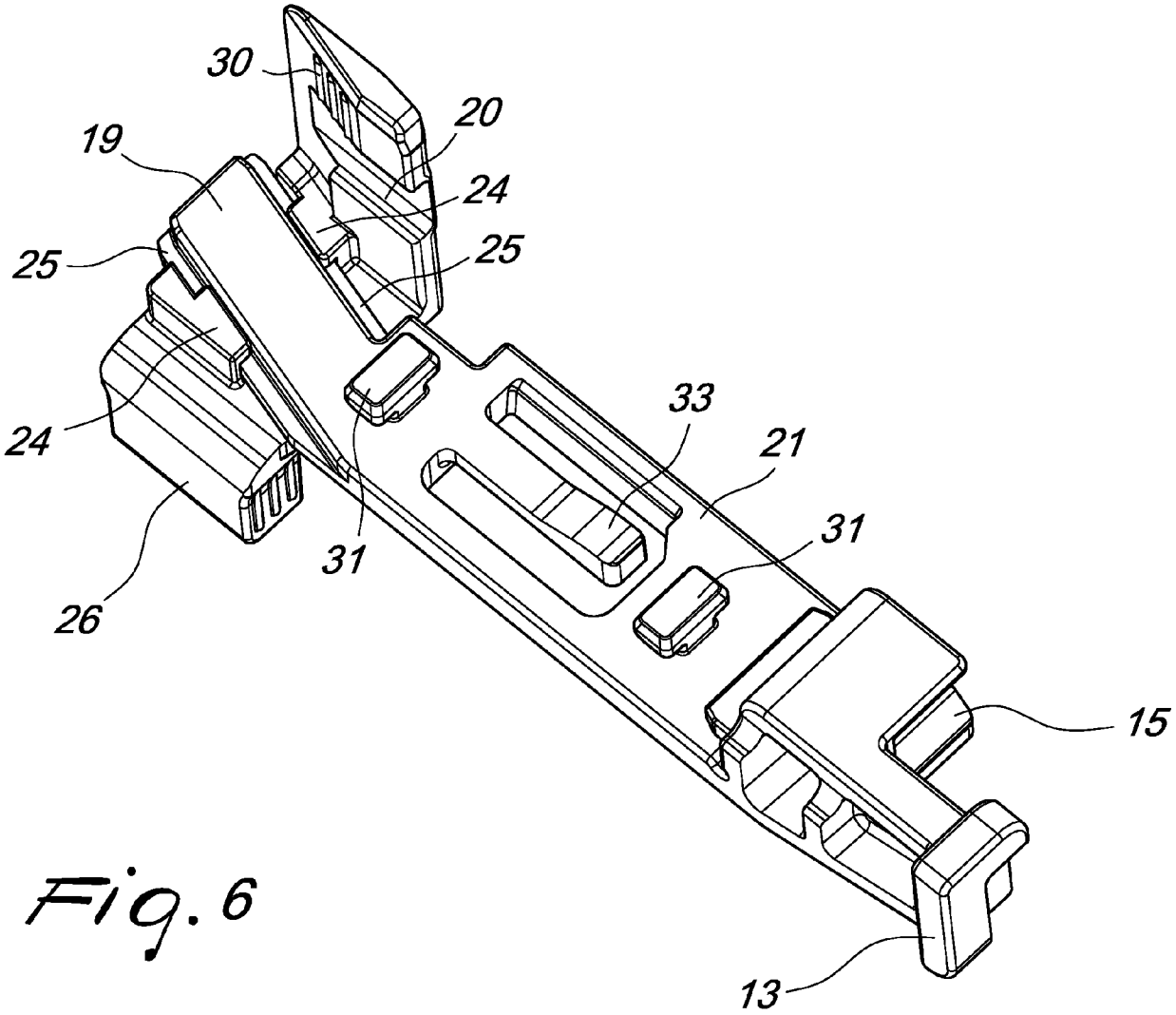
FIG. 6 is a perspective view of the height adjustment device for the drawer, removed from the pull-out guide.

As better illustrated in FIG. 6, the connection part 23 preferably has on one side mutually opposite lips or tongues 24 for anchoring the part 23 to the guide element 19; in particular the guide element 19 is provided in an upward region and in a downward region with retaining ribs or edges 25 with which the anchoring lips 24 engage in such a way as to permit the sliding of the connection part 23 and therefore of the support member 20 along the guide element 19.

The connection part 23 is likewise provided with a gripping part 26 which extends on a side opposite from the guide element 19, so as to be manually actuated.

The guide element 19 preferably has an angle of inclination comprised between 10° and 20° with respect to the longitudinal axis of the movable guide part 12, so as to allow an easy actuation of the support member 20 and prevent the element from loosening in an unwanted manner.

In order to keep the support member 20 locked in the desired adjustment position, suitable locking means are provided; preferably the locking means for the support member 20 have first locking means which comprise a toothing 27 provided on the guide element 19 and an engagement tab 28 provided on the part for connection 23 and shaped to engage with that toothing 27, and second locking means which comprise a first toothing 29 provided on a downward-bent section of the movable guide part 12, at the opening 22, and a second toothing 30 provided under the support member 20, such toothings being engageable with each other in order to keep the support member 20 in position.

The front stop element 13 of the embodiment shown extends to a front end of the fastening body 21 so as to protrude downward in order to come into contact with the bent front portion 14 of the fixed guide part 11 when the guide is in the closed position.

As mentioned, the pull-out guide 10 according to the present invention can also lack the stop element 13 or the front centering element 15, with the guide element 19 still being separated from the movable guide part 12 and being made in a single piece at least either with the front stop element 13 or with the front centering element 15.

Figure 3:
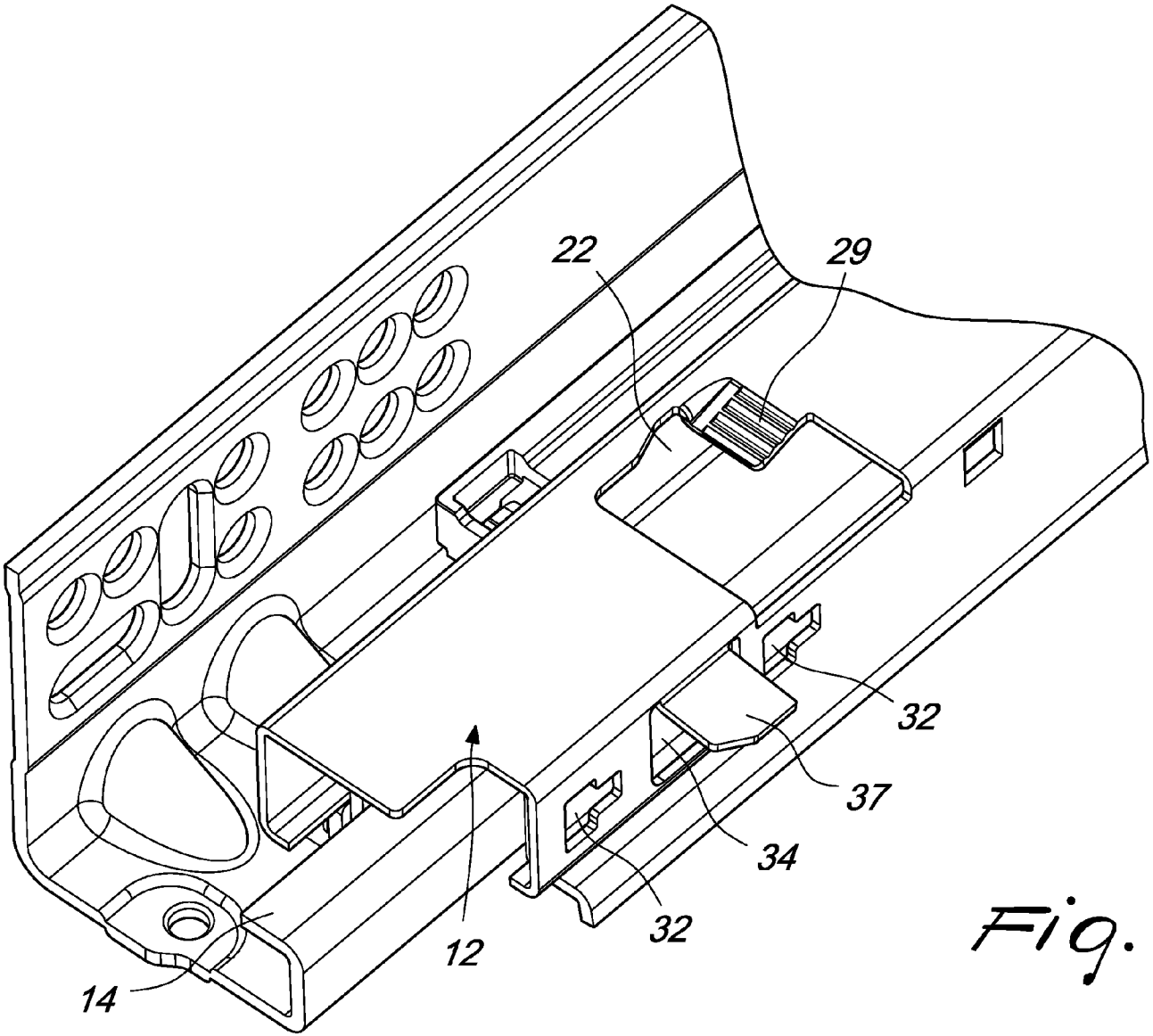
FIG. 3 is a view of the front part of the pull-out guide in FIG. 1, in which the height adjustment device for the drawer has been removed.

The fastening body 21 has hooking means for fastening to the movable guide part 12; preferably, as shown in FIGS. 3 and 6, the hooking means comprise at least one first and one second mushroom-shaped projection 31 which are arranged spaced apart from each other on one side of the fastening body 21 which is directed toward the side wall 12' of the movable guide part 12, such mushroom-shaped projections 31 being hookable in a bayonet-like manner by sliding in corresponding contoured openings 32 provided in the side wall 12'.

In order to keep the fastening body 21 locked once hooked to the side wall 12', there is an elastic tab 33 which can engage a corresponding opening 34 in the side wall 12'.

The clip hooking device 18 preferably has a main body 35 which can be fastened to the front wall or to the bottom of the drawer, for example by way of screws, such body 35 supporting an engagement element 36 which can engage a side tab 37 provided on the movable guide part 12.

In order to manually actuate the engagement element 36, there is a lever 38 which is supported so as to oscillate by the body 35 and which is connected to the engagement element 36.

In the embodiment shown, the front centering element is constituted by the engagement seat 15 provided at the front end of the fastening body 21, in a single piece with the guide element 19 for the support member 20, while the centering element which is integral with the front part of the drawer is configured as a wedge element 17 connected to the hooking device 18, for example made in a single piece with the body 35, or preferably connected to lateral adjustment means for the drawer which are provided on the hooking device 18, which comprise for example a threaded pivot integral with the wedge element 17 and a control leadscrew supported so that it can turn, but not so that it can move axially, by the body 35 of the hooking device 18.

In practice it has been found that the pull-out guide for drawers provided with the height adjustment device of the drawers according to the present invention achieves the set aim and objects and that in particular it is simple in construction and assembly of the various components of the guide is rapid and easy, by virtue of the integration of the guide element of the adjustment device and the front stop element and/or the front centering element in a single body.

Furthermore the pull-out guide according to the present invention achieves excellent structural characteristics and strength, which enable a correct operation of the pull-out guide by virtue of the arrangement of the support member of the adjustment device and by virtue of the integration in construction of the various elements.

The pull-out guide for drawers provided with the height adjustment device of the drawers according to the invention is susceptible of modifications and variations, all of which are within the scope of the appended claims. Moreover, all the details may be substituted by technically equivalent elements.

In practice the materials employed, and the contingent dimensions and shapes, may be any according to requirements and to the state of the art.

The disclosures in Italian Patent Application No. 102018000007604 from which this application claims priority are incorporated herein by reference.

The invention claimed is:

1. A pull-out guide for drawers, which comprises:

a fixed guide part which can be anchored to the body of an item of furniture; and a movable guide part on which a drawer can be fastened, said movable guide part extending along a longitudinal axis and being provided with a front stop element and/or with a front centering element which are conformed and arranged respectively for coming into contact with the fixed guide part at a closed position of the pull-out guide and/or for engaging with an element that is integral with a front part of said drawer, wherein said front centering element comprises one of an engagement seat and a wedge element, wherein said front centering element is provided at a front end of the movable guide part, wherein said front part of said drawer comprises the other of the engagement seat and the wedge element, the pull-out guide being further provided with a height adjustment device of the drawer with respect to the movable guide part, the adjustment device comprising a movable support member for the drawer, wherein the adjustment device comprises a guide element for the movable support member, said guide element of the adjustment device being separated from the movable guide part and provided in a single piece with said front stop element and/or said front centering element and wherein the guide element extends inclined with respect to a longitudinal axis of the movable guide part.

2. The pull-out guide according to claim 1, wherein the guide element protrudes inclined at a rear end of a fastening body fastened to a side wall of the movable guide part, said front stop element and/or said front centering element being provided at a front end of the fastening body.

3. The pull-out guide according to claim 2, wherein the guide element protrudes towards the rear end of the pull-out guide with an upward inclination.

4. The pull-out guide according to claim 2, wherein the guide element and the fastening body are flat and extend along a plane parallel to the side wall of the movable guide part.

5. The pull-out guide according to claim 1, wherein the movable support member for the drawer is configured as a slider which is slideably connected to the guide element.

6. The pull-out guide according to claim 5, wherein the movable support member is movable between a first position, in which it is lowered in a position of minimum adjustment such as to lie in the same plane as the upper wall of the movable guide part, and a second position, in which it is in a raised position for moving the drawer upward with respect to the upper wall of the movable guide part.

7. The pull-out guide according to claim 1, wherein the movable support member has a flat shape and extends at an opening in an upper wall of the movable guide part along a plane that is substantially parallel to said upper wall.

8. The pull-out guide according to claim 2, wherein said movable support member protrudes from a lateral part for connection to the guide element, the lateral part extending parallel to and side-by-side with said guide element on an opposite side of the guide element from the side wall of the movable guide part.

9. The pull-out guide according to claim 8, wherein the lateral part has on one side mutually opposite lips or tongues for anchoring to the guide element, said guide element being provided with retaining ribs or edges with which the anchoring lips engage in such a way as to permit the sliding of the part for connection along the guide element.

10. The pull-out guide according to claim 8, wherein the lateral part has a gripping part for manual actuation.

11. The pull-out guide according to claim 1, wherein the guide element has an angle of inclination comprised between 10° and 20° with respect to the longitudinal axis of the movable guide part.

12. The pull-out guide according to claim 1, further comprising locking means for keeping the support member locked in a selected adjustment position.

13. The pull-out guide according to claim 12, wherein said locking means for the support member have first locking means which comprise a toothing on the guide element and an engagement tab for said toothing on a lateral part for connection to the guide element, and second locking means which comprise a first toothing provided at an opening in an upper wall of the movable guide part and a second toothing provided under the support member, which are mutually engageable.

14. The pull-out guide according to claim 4, wherein the fastening body has hooking means for hooking to the side wall of the movable guide part, said hooking means comprising at least one first and one second engagement projection which are arranged spaced apart from each other on one side of the fastening body and which can be hooked in a bayonet-like manner in corresponding shaped openings which are provided in said side wall.

* * * * *